US011392060B2

(12) United States Patent
Matsunae

(10) Patent No.: US 11,392,060 B2
(45) Date of Patent: Jul. 19, 2022

(54) POWDER TRANSPORT DEVICE AND POWDER USING APPARATUS

(71) Applicant: FUJIFILM BUSINESS INNOVATION CORP., Tokyo (JP)

(72) Inventor: Suguru Matsunae, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/986,489

(22) Filed: Aug. 6, 2020

(65) Prior Publication Data

US 2021/0302875 A1 Sep. 30, 2021

(30) Foreign Application Priority Data

Mar. 26, 2020 (JP) ..... JP2020-055410

(51) Int. Cl.
*G03G 15/08* (2006.01)
*G03G 21/20* (2006.01)

(52) U.S. Cl.
CPC ..... *G03G 15/0891* (2013.01); *G03G 15/0879* (2013.01); *G03G 21/20* (2013.01); *G03G 15/0848* (2013.01); *G03G 2215/0668* (2013.01)

(58) Field of Classification Search
CPC ..... G03G 15/0891; G03G 15/0877; G03G 15/0879; G03G 15/104; G03G 15/105; G03G 15/0848; G03G 2215/0668; G03G 21/20; G03G 2215/00084
See application file for complete search history.

(56) References Cited

U.S. PATENT DOCUMENTS

| | | | | | |
|---|---|---|---|---|---|
| 4,884,109 | A * | 11/1989 | Hill | G03G 15/0877 | 399/261 |
| 2004/0203413 | A1* | 10/2004 | Harumoto | G03G 15/553 | 455/66.1 |
| 2006/0104670 | A1* | 5/2006 | Nishitani | G03G 15/0875 | 399/258 |
| 2014/0178089 | A1* | 6/2014 | Pino | G03G 15/161 | 399/71 |
| 2015/0277293 | A1* | 10/2015 | Maehara | G03G 15/0891 | 399/258 |
| 2016/0074900 | A1 | 3/2016 | Okamoto et al. | | |
| 2017/0068205 | A1* | 3/2017 | Shinotsuka | G03G 15/0889 | |
| 2017/0090349 | A1* | 3/2017 | Noguchi | G03G 15/0877 | |
| 2017/0115606 | A1* | 4/2017 | Sakamaki | G03G 15/0891 | |
| 2017/0139365 | A1* | 5/2017 | Ootsuka | G03G 15/0867 | |

FOREIGN PATENT DOCUMENTS

| | | | | |
|---|---|---|---|---|
| JP | 2000-172076 A | | 6/2000 | |
| JP | 2004-021230 A | | 1/2004 | |
| JP | 2005049689 A | * | 2/2005 | G03G 21/105 |
| JP | 2011-059210 A | | 3/2011 | |
| JP | 2016-059869 A | | 4/2016 | |

* cited by examiner

*Primary Examiner* — Walter L Lindsay, Jr.
*Assistant Examiner* — Laura Roth
(74) *Attorney, Agent, or Firm* — Oliff PLC

(57) ABSTRACT

A powder transport device includes a transport unit, a spiral first transport member, and a first driving unit. The transport unit has a transport path. The first transport member is rotatably disposed in the transport path and rotates forward to transport powder. The first driving unit drives the first transport member to rotate. The first driving unit rotates the first transport member in reverse when both (i) a non-operation time during which the first transport member is not rotated and (ii) detection information on a temperature satisfy a condition.

13 Claims, 9 Drawing Sheets

FIG.6A

| REVERSE ROTATION OPERATION (NUMBER OF TIMES) | | NON-OPERATION TIME j (TIME) | | |
|---|---|---|---|---|
| | | j < A | A ≦ j < B | B ≦ j < C |
| TEMPERATURE t (℃) | t < D | NOT PERFORMED | ONCE | TWICE |
| | D ≦ t < E | ONCE | TWICE | THREE TIMES |
| | E ≦ t | TWICE | THREE TIMES | FIVE TIMES |

(A<B<C)、(D<E)

FIG.6B

| REVERSE ROTATION OPERATION (NUMBER OF TIMES) | | NON-OPERATION TIME j (TIME) | | |
|---|---|---|---|---|
| TEMPERATURE t (℃) | HUMIDITY h (%RH) | j < A | A ≦ j < B | B ≦ j < C |
| t < D | h < F | NOT PERFORMED | NOT PERFORMED | ONCE |
| | F ≦ h < G | NOT PERFORMED | ONCE | TWICE |
| | G ≦ h | ONCE | ONCE | TWICE |
| D ≦ t < E | h < F | NOT PERFORMED | ONCE | TWICE |
| | F ≦ h < G | ONCE | TWICE | THREE TIMES |
| | G ≦ h | TWICE | TWICE | THREE TIMES |
| E ≦ t | h < F | ONCE | TWICE | THREE TIMES |
| | F ≦ h < G | TWICE | THREE TIMES | FOUR TIMES |
| | G ≦ h | THREE TIMES | FOUR TIMES | FIVE TIMES |

(A<B<C)、(D<E)、(F<G)

POWDER TRANSPORT DEVICE AND POWDER USING APPARATUS

CROSS-REFERENCE TO RELATED APPLICATIONS

This application is based on and claims priority under 35 USC 119 from Japanese Patent Application No. 2020-055410 filed Mar. 26, 2020.

BACKGROUND

1. Technical Field

The present disclosure relates to a powder transport device and a powder using apparatus.

2. Related Art

In the related art, as a device that transports powder, for example, those described in JP-A-2016-59869 ([0024], [0045], and FIGS. 1 and 2) and JP-A-2000-172076 ([0033] to [0037], [0042] and FIGS. 1 to 10) have been known.

JP-A-2016-59869 describes a device including a transport pipe which interconnects a storage unit that stores a powder coating material and a coating unit that performs coating using the powder coating material to transport the powder coating material from the storage unit to the coating unit and an agitation transport member (for example, a member having a spiral blade) which is disposed in the transport pipe to agitate and transport the powder coating material.

JP-A-2000-172076 describes a device including a powder pump unit which transports a toner as powder from a toner receiving container to a developing device.

JP-A-2000-172076 describes that the powder pump unit has a suction type uniaxial eccentric screw pump, and the screw pump includes a screw-shaped rotor, a double-pitch screw-shaped stator, a holder surrounding the stator and defining a powder transport path, and a motor as a driving unit which is rotatable forward or in reverse.

JP-A-2000-172076 further describes that when it is considered that toner replenishment is continuously performed several times within a short time, the screw pump is driven to rotate in reverse immediately after a shutdown thereof after completion of the continuous replenishment.

SUMMARY

Aspects of non-limiting embodiments of the present disclosure relate to a powder transport device and a powder using apparatus that are capable of preventing powder from blocking or narrowing a transport path in which a spiral first transport member that rotates forward to transport powder is disposed, as compared with a case where the first transport member is not rotated in reverse when both (i) a non-operation time during which the first transport member is not rotated and (ii) detection information on a temperature satisfy a condition.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder transport device including a transport unit, a spiral first transport member, and a first driving unit. The transport unit has a transport path. The first transport member is rotatably disposed in the transport path and rotates forward to transport powder. The first driving unit drives the first transport member to rotate. The first driving unit rotates the first transport member in reverse when both (i) a non-operation time during which the first transport member is not rotated and (ii) detection information on a temperature satisfy a condition.

BRIEF DESCRIPTION OF THE DRAWINGS

Exemplary embodiment(s) of the present disclosure will be described in detail based on the following figures, wherein:

FIG. 4 is a flowchart illustrating a control operation for the replenishment device and the like;

FIG. 6A is a table illustrating an example of a combined condition used for a reverse rotation operation;

FIG. 6B is a table illustrating another example of the combined condition;

DETAILED DESCRIPTION

Hereinafter, exemplary embodiments to practice the present disclosure will be described with reference to the accompanying drawings.

First Exemplary Embodiment

Figure 1:
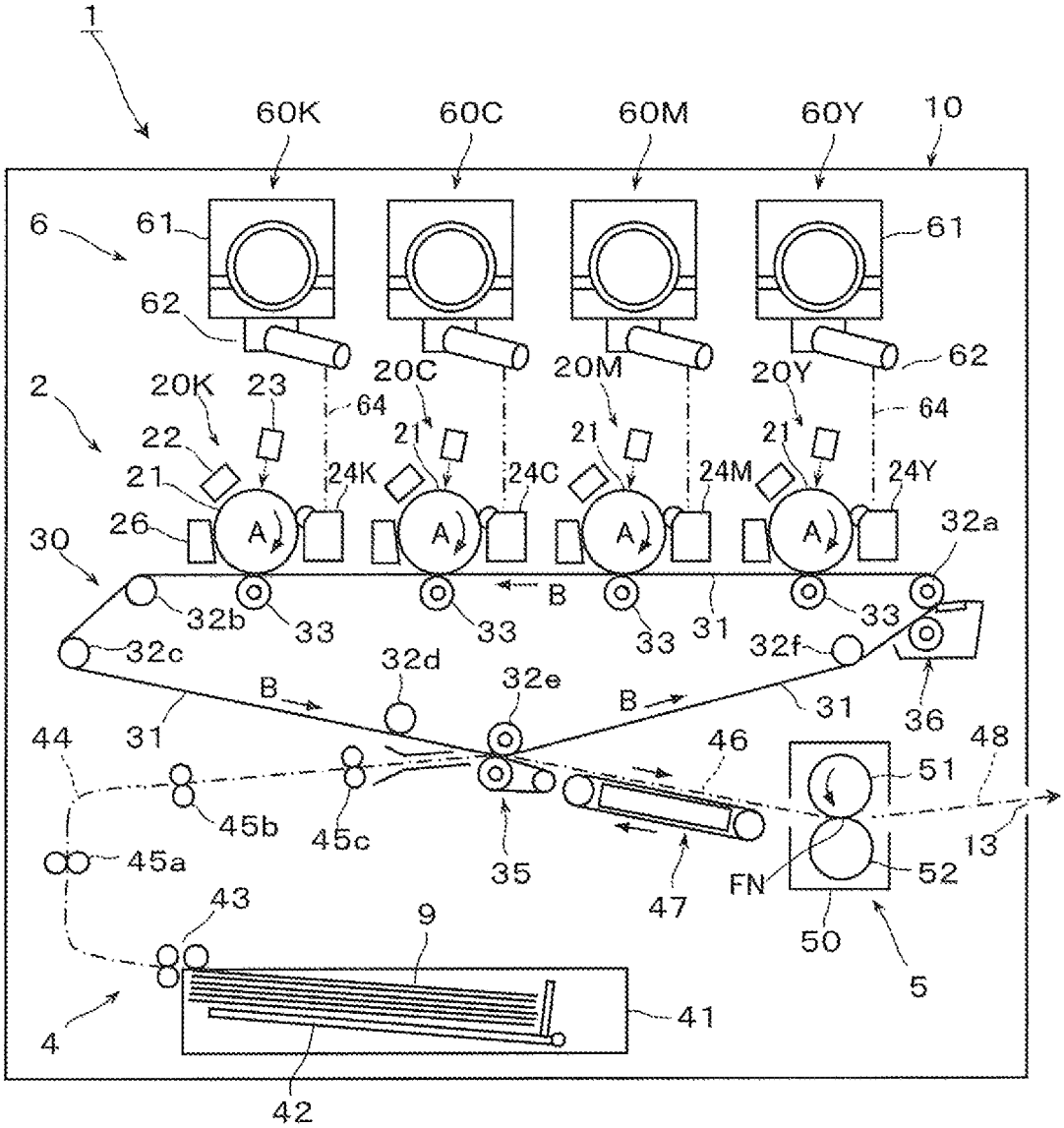
FIG. 1 is a schematic view illustrating an image forming apparatus according to a first exemplary embodiment.
Figure 2:
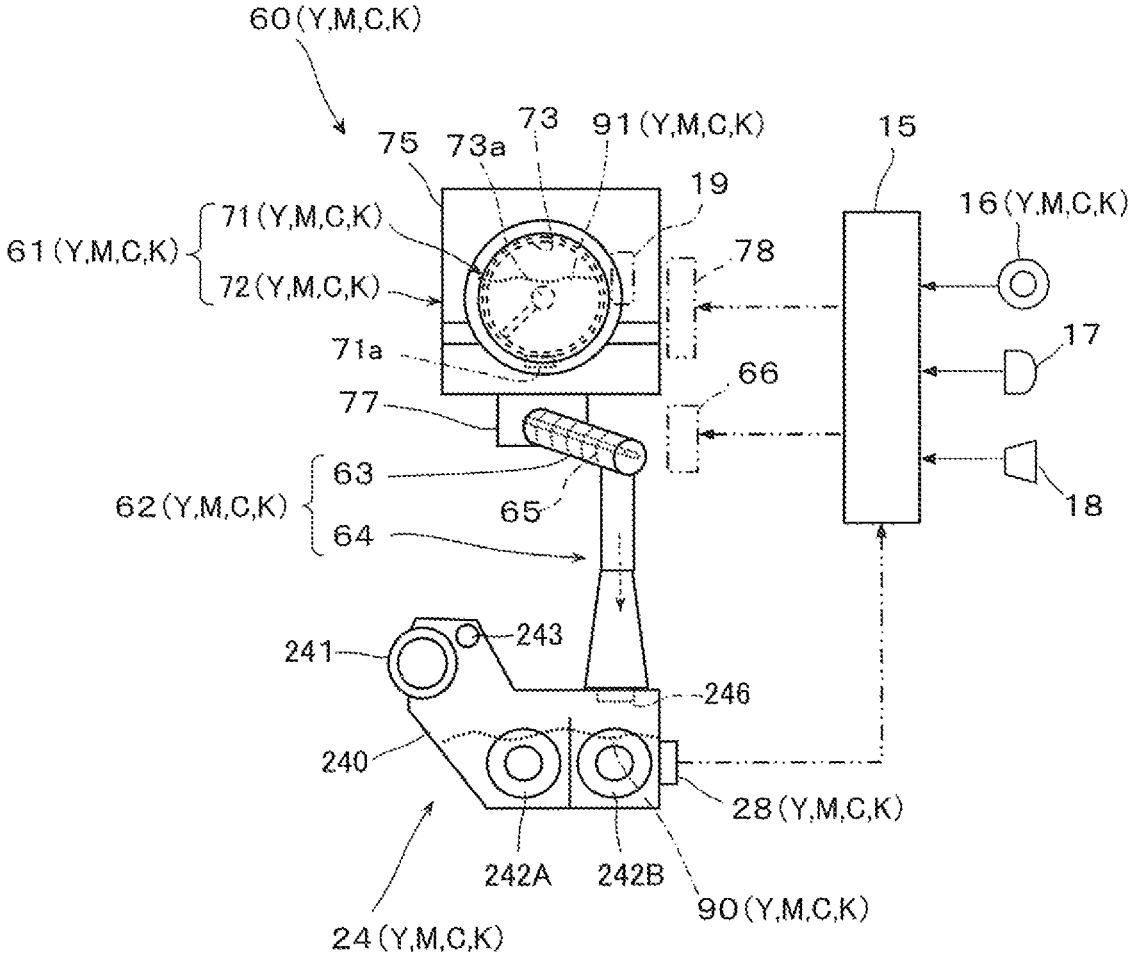
FIG. 2 is a schematic view illustrating a replenishment device according to the first exemplary embodiment.

FIGS. 1 and 2 are views illustrating a first exemplary embodiment of the present disclosure. FIG. 1 illustrates the entire image forming apparatus 1 according to a first exemplary embodiment, and FIG. 2 illustrates a part of the image forming apparatus 1 (for example, a replenishment device).

<Image Forming Apparatus>

As illustrated in FIG. 1, the image forming apparatus 1 includes a case 10 defining a required external appearance, and is provided with an image forming section 2, a sheet feeding section 4, a heating and pressurizing section 5, a power supply (not illustrated), a controller, and the like in the internal space of the case 10.

The image forming section 2 is a section that forms an image made of a developer which is an example of powder and transfers the image onto a sheet 9 which is an example of a recording medium. When a two-component developer containing, for example, a toner and a carrier is used as the developer, the image made of the developer is a toner image made of the toner which is also a part of powder in the two-component developer.

As illustrated in FIG. 1, the image forming section 2 according to the first exemplary embodiment includes four image forming devices 20Y, 20M, 20C, 20K which exclusively form toner images of four colors including yellow (Y), magenta (M), cyan (C), and black (K) respectively and an intermediate transfer device 30 which relays and transports the respective toner images formed by the four image forming devices 20(Y, M, C, K) to a position at which the toner images are transferred onto the sheet 9.

All the four image forming devices 20(Y, M, C, K) have substantially the same configuration except that the used developers (that is, toners thereof) have different colors.

That is, each of the image forming devices 20(Y, M, C, K) has a photoconductive drum 21 which is driven to rotate in the direction indicated by the arrow A. In each of the image forming devices 20(Y, M, C, K), devices are provided such as a charging device 22, an exposure device 23, a developing device 24(Y, M, C, K), and a drum cleaning device 26 around the photoconductive drum 21. In FIG. 1, all reference numerals 21 to 23 and 26 are illustrated only in the image forming device 20K of black (K), and some of them are illustrated in the image forming devices 20(Y, M, C) of other colors.

The photoconductive drum 21 is an example of an image carrier, and is a photoconductor in the form of a drum having a photoconductive layer serving as an image forming surface and an image carrying surface. The charging device 22 is a device that charges the outer circumferential surface (image forming surface) of the photoconductive drum 21 to a required surface potential. The exposure device 23 is an example of a light irradiation device, and is a device that irradiates the outer circumferential surface of the photoconductive drum 21 with light according to image information to form an electrostatic latent image for a corresponding one of the four colors (Y, M, C, K). The image information is information related to images such as, for example, characters, figures, patterns, and photographs, which are input from the outside.

The developing device 24(Y, M, C, K) is an example of an operating unit that operates so as to use a developer 90 which is an example of powder, and is a device that develops each electrostatic latent image formed on the outer circumferential surface of each photoconductive drum 21 using a developer (toner) of a corresponding one of the four colors (Y, M, C, K) to form a toner image of each color. The drum cleaning device 26 is a device that removes an unnecessary substance adhering to the outer circumferential surface of the photoconductive drum 21 during rotation to clean the outer circumferential surface.

In these four image forming devices 20Y, 20M, 20C, 20K, a charging operation by the charging device 22, an exposure operation by the exposure device 23, a developing operation by the developing device 24(Y, M, C, K), and the like are performed respectively on each photoconductive drum 21 which is rotated in the direction indicated by the arrow A.

Thus, toner images of the four colors (Y, M, C, K) are individually formed on respective photoconductive drums 21 of the image forming devices 20(Y, M, C, K). The toner images of the four colors are transported respectively to respective primary transfer positions to be described later between the respective photoconductive drums 21 and the intermediate transfer device 30 by rotation of the photoconductive drums 21. Only some of the image forming devices 20(Y, M, C, K) may operate to form a toner image of a corresponding color.

As illustrated in FIG. 1, the intermediate transfer device 30 has an intermediate transfer belt 31 which is an example of an image carrier or an intermediate transfer body. In the intermediate transfer device 30, devices are provided such as a primary transfer device 33, a secondary transfer device 35, and a belt cleaning device 36 around the intermediate transfer belt 31.

The intermediate transfer belt 31 is an endless belt having a required width and length, and is configured to carry a toner image on the outer circumferential surface thereof. The intermediate transfer belt 31 is supported by plural support rollers 32*a* to 32*f* disposed on the inner circumferential surface side thereof so as to be kept in a state of rotating (circulating) in the direction indicated by the arrow B to sequentially pass through primary transfer positions facing the respective photoconductive drums 21 of the image forming devices 20(Y, M, C, K) and then, also pass through a secondary transfer position facing the sheet 9.

The primary transfer device 33 is a device that primarily transfers each toner image formed on the photoconductive drum 21 of each of the image forming devices 20(Y, M, C, K) onto the outer circumferential surface of the intermediate transfer belt 31 by a primary transfer action such as an electrostatic action. For example, the primary transfer device 33 is configured with a contact type transfer device that uses a primary transfer roller to which a transfer bias is supplied. The secondary transfer device 35 is a device that secondarily transfers the toner image primarily transferred onto the outer circumferential surface of the intermediate transfer belt 31 onto the sheet 9 by a secondary transfer action such as an electrostatic action. For example, the secondary transfer device 35 is configured with a contact type transfer device that accommodates a secondary transfer roller to which a transfer bias is supplied. The belt cleaning device 36 is a device that removes an unnecessary substance adhering to the outer circumferential surface of the intermediate transfer belt 31 during rotation to clean the outer circumferential surface.

Next, the sheet feeding section 4 is a section that accommodates and delivers the sheet 9 to be fed to a position at which the transfer of an image is performed in the image forming section 2.

The sheet feeding section 4 according to the first exemplary embodiment is configured to feed the sheet 9 to the secondary transfer position in the intermediate transfer device 30 since the image forming section 2 includes the intermediate transfer device 30. The sheet feeding section 4 is configured with a sheet feeding device including, for example, an accommodating body 41 in which plural sheets 9 are stacked and accommodated on a loading plate 42 and the like in a required orientation, a delivery device 43 which delivers the sheets 9 accommodated in the accommodating body 41 one by one, and a sheet feeding transport path 44 which transports the sheet 9 delivered from the delivery device 43 to the secondary transfer position. For example, plural accommodating bodies 41 may be provided.

The sheet feeding transport path 44 is a sheet transport path that transports the sheet 9 delivered from the sheet feeding section 4 so as to feed the sheet 9 to the secondary transfer position at a required timing. In the sheet feeding transport path 44, for example, plural transport rollers 45*a* to 45*c* which nip and transport the sheet 9 and plural guide members (not illustrated) which secure a transport space for the sheet 9 and guide the transport of the sheet 9 are provided.

The sheet 9 is, for example, a recording medium that may be transported in the case 10 to enable the transfer and fixing of a toner image thereon.

In the intermediate transfer device 30, four color toner images formed on the respective photoconductive drums 21 of the image forming devices 20(Y, M, C, K) are primarily transferred respectively so as to be sequentially superposed on the outer circumferential surface of the intermediate transfer belt 31 which is rotated in the direction indicated by the arrow B by a primary transfer operation of the primary transfer devices 33 and thereafter, the primarily transferred toner images are transported to the secondary transfer position facing the secondary transfer device 35.

Meanwhile, the sheet feeding section 4 feeds the required sheet 9 as the sheet 9 is delivered by the delivery device 43 at the timing of forming and transporting the toner images in the image forming section 2 and thereafter, is transported to the secondary transfer position by the sheet feeding transport path 44.

Thus, at the secondary transfer position in the intermediate transfer device 30, the toner images primarily transferred onto and transported by the intermediate transfer belt 31 are secondarily transferred onto one surface of the sheet 9 by a secondary transfer operation of the secondary transfer device 35.

Next, the heating and pressurizing section 5 is a section that heats and pressurizes the toner image transferred onto the sheet 9 in the image forming section 2 to fix the toner image on the sheet 9.

As illustrated in FIG. 1, the heating and pressurizing section 5 according to the first exemplary embodiment is configured with a fixing device in which devices such as a heating rotating body 51 and a pressurizing rotating body 52 are disposed in the internal space of a case 50 provided with an introduction port and a discharge port for the sheet 9.

In the heating and pressurizing section 5, the heating rotating body 51 and the pressurizing rotating body 52 rotate in contact with each other in the rotation axis direction thereof. Further, a region in which the heating rotating body 51 and the pressurizing rotating body 52 come into contact with each other is configured as a fixing processing region (nip portion) FN that passes therethrough the sheet 9 having the transferred toner image in a nipped state and performs processing such as heating and pressurization for fixing the toner image on the sheet 9 at the time of passage.

In the heating and pressurizing section 5, the sheet 9 after completion of secondary transfer is transported by a relay transport path 46 and is introduced into the fixing processing region FN. For example, in the relay transport path 46, a suction type belt transport device 47 is provided.

Thus, in the fixing processing region FN of the heating and pressurizing section 5, the toner image secondarily transferred onto the sheet 9 is heated and pressurized to be fixed on the sheet 9.

By a basic image forming operation by the image forming apparatus 1 described above, a desired multicolor or monochromatic image is formed on one surface of the sheet 9.

Further, the sheet 9 on which the image has been completely formed is discharged to a discharged sheet accommodating unit (not illustrated) via a discharge transport path 48. In the discharge transport path 48, for example, a transport roller, a discharge roller (not illustrated), and plural guide members (not illustrated) that guide the transport of the sheet 9 are provided.

<Developer Replenishment Device and Others>

Further, in the image forming apparatus 1, as illustrated in FIG. 1 or FIG. 2, the respective developing devices 24(Y, M, C, K) of the image forming devices 20(Y, M, C, K) are replenished with replenishment developers 91(Y, M, C, K) of a required amount corresponding to the amount of a developer to be consumed, for example, by a developing operation from respective replenishment devices 60(Y, M, C, K) which are an example of a powder transport device 6.

First, the developing device 24(Y, M, C, K) is an example of an operating unit that operates so as to use the developer 90 which is an example of powder as described above, and as illustrated in FIG. 2 or FIG. 3, is configured by arranging, within a main body (case) 240 provided with an accommodating portion for the developer 90 or a developing opening, components such as a developing roller 241 which performs developing by holding the developer 90 in the accommodating portion and transporting the developer 90 so as to approach and pass through the photoconductive drum 21 from the developing opening, transport members 242A and 242B which agitate and transport the developer 90 in the accommodating portion, and an adjustment member 243 which adjusts the amount (layer thickness) of the developer 90 held by the developing roller 241.

Figure 3:
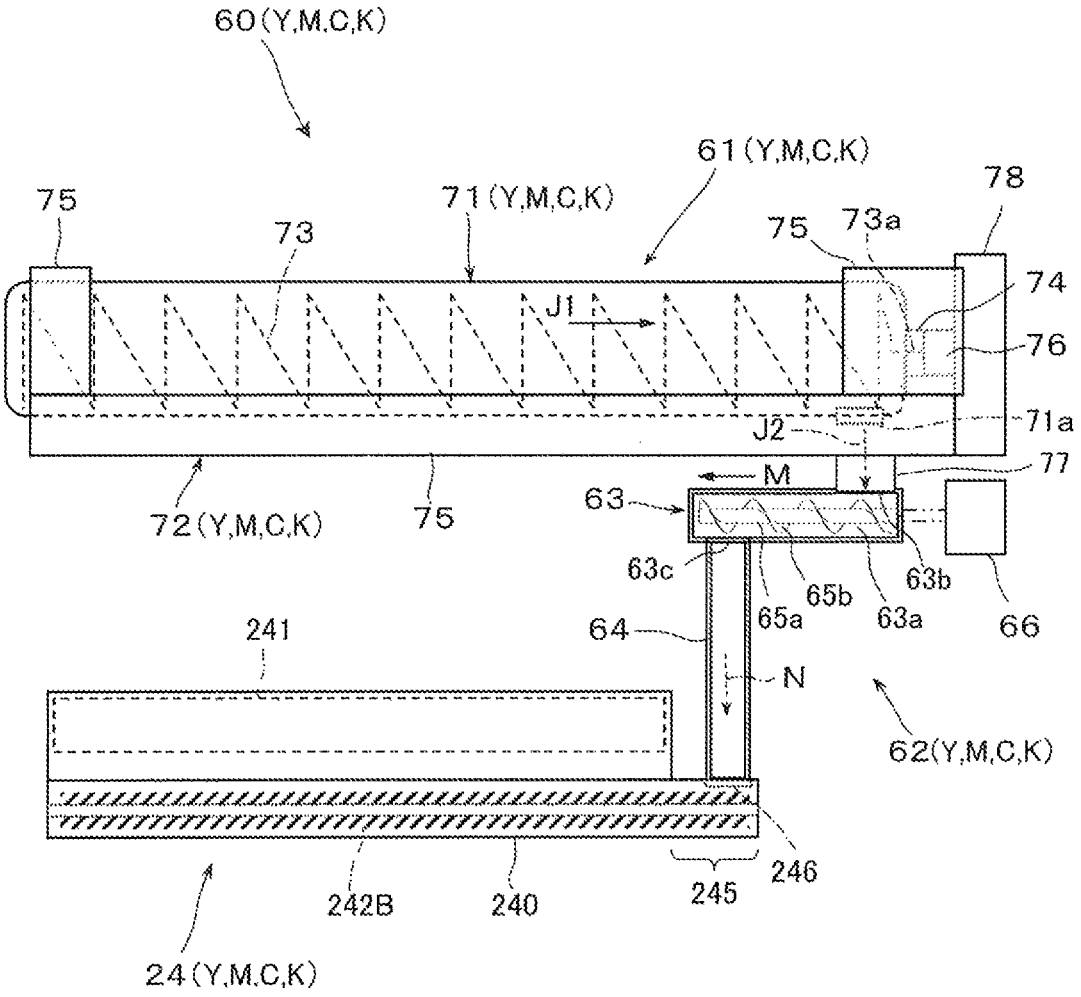
FIG. 3 is a schematic view illustrating the replenishment device of FIG. 2 as viewed from the lateral side.

The main body 240 has a long shape in a direction substantially along the axial direction of the photoconductive drum 21. As illustrated in FIG. 3, a developer replenishment portion 245 is provided on one longitudinal end of the main body 240 to protrude from the end. Further, the transport member 242B extends to and is disposed in the developer replenishment portion 245, and the developer replenishment portion 245 is provided with a receiving port 246 that receives the replenishment developer 91.

Next, each of the replenishment devices 60(Y, M, C, K) according to the first exemplary embodiment includes an accommodating unit 61(Y, M, C, K) which individually accommodates a corresponding one of four color replenishment developers 91(Y, M, C, K) and a transport unit 62(Y, M, C, K) which transports the corresponding developer 91(Y, M, C, K) from the accommodating unit 61(Y, M, C, K) to the developing device 24(Y, M, C, K).

When the developer 90 used in the developing device 24(Y, M, C, K) is a two-component developer, the replenishment developer 91 is, for example, only a toner or a toner containing a small amount of carrier.

The accommodating unit 61(Y, M, C, K) includes a developer container 71(Y, M, C, K) which is an example of a powder container that individually accommodates the developer 91(Y, M, C, K) and a mounting device 72(Y, M, C, K) for individually and detachably mounting the developer container 71(Y, M, C, K).

The developer container 71(Y, M, C, K) is a replaceable cartridge type container. Further, the developer container 71 includes a cylindrical container main body provided with a developer discharge port 71*a*, a second transport member 73 is disposed within the container main body to transport the developer toward the discharge port 71*a* by rotation thereof, and a driven-side transmission joint 74 is provided on one end of the container main body to transmit a rotational force received from the outside to the second transport member 73.

The discharge port 71*a* is opened and closed by an opening and closing shutter (not illustrated) which is moved in conjunction with an attachment and detachment operation of the developer container 71. The second transport member 73 is, for example, a member that is entirely formed in a spiral shape and has one end formed as a rotating shaft portion 73*a*, that is, a so-called agitator. The transmission joint 74 is a shaft coupling (coupling) which may be coupled to and separated from a driving-side transmission joint, and protrudes from the end of the container body.

The mounting device 72(Y, M, C, K) includes a container holding part 75 which detachably holds a lower portion or front and rear ends of the developer container 71(Y, M, C, K), a driving-side transmission joint 76 which is coupled to the transmission joint 74 on the developer container 71(Y, M, C, K) to transmit the rotational force, a developer receiving part 77 which faces the discharge port 71*a* of the developer container 71 held by the container holding part 75 to receive the replenishment developer 91 discharged therefrom, and a second driving device 78 which is an example of a second driving unit that drives the second transport member 73 to rotate via the driving-side transmission joint 76.

The driving-side transmission joint 76 is a shaft coupling (coupling) which may be coupled to and separated from the driven-side transmission joint 74, and is provided on an end holding portion of the container holding part 75 that holds a back side end of the developer container 71 at the time of mounting of the developer container 71.

The developer receiving part 77 is a part that faces the discharge port 71*a* of the developer container 71 and serves to temporarily receive and store the replenishment developer 91 and also to transmit the developer 91 to the transport unit 62 (that is, a first transport member 65 thereof to be described later).

The second driving device 78 includes a motor, a gear train mechanism, and the like.

The transport unit 62(Y, M, C, K) includes a transport pipe 63 having one end connected to the developer receiving part 77 of the mounting device 72(Y, M, C, K), a connection pipe 64 which interconnects the other end of the transport pipe 63 and a receiving port 246 of the developer replenishment portion 245 of the developing device 24, the first transport member 65 which rotates forward in a transport portion of the transport pipe 63 to transport the replenishment developer 91, and a first driving device 66 which is an example of a first driving unit that drives the first transport member 65 to rotate.

The transport pipe 63 is an example of a transport unit having a transport path. The transport pipe 63 is, for example, a cylindrical pipe, and the inside thereof defines a tubular transport path 63*a*. Further, the transport pipe 63 is provided in one end thereof with a connection port 63*b* connected to the developer receiving part 77 and provided in the other end thereof with a discharge port 63*c* from which the replenishment developer 91 is discharged to drop to the connection pipe 64.

The connection pipe 64 is constituted as a cylindrical hollow pipe having no transport member disposed therein, and is, for example, configured to drop and transport the replenishment developer 91 toward the receiving port 246 of the developer replenishment portion 245.

As illustrated in FIG. 3, the first transport member 65 is a member that includes a rotating shaft 65*a* extending along the transport path 63*a* of the transport pipe 63 and a transport blade 65*b* continuously formed on the outer circumferential surface of the rotating shaft 65*a* so as to be spirally wound thereon, that is, a so-called screw auger. The first transport member 65 transports the replenishment developer 91 in a transport direction M so as to move the replenishment developer 91 toward the discharge port 63*c* of the transport pipe 63. A transport operation by forward rotation of the first transport member 65 is executed so as to correspond to a required replenishment amount of the replenishment developer 91. The forward rotation is rotation in one predetermined direction necessary to realize the transport direction M of the first transport member 65. The first transport member 65 is disposed such that the transport blade 65*b* thereof rotates in a state of being close to the transport path 63*a* of the transport pipe 63.

The first driving device 66 includes a motor, a gear train mechanism, and the like.

Further, an operation of the replenishment device 60(Y, M, C, K) is controlled by a control device 15 as illustrated in FIG. 2.

The control device 15 performs an arithmetic processing according to a control program and control information (including detection information) related to the control of a developer replenishment operation, for example, to output a control command and the like necessary for a control target, and is configured with a microcomputer and the like. The control device 15 may be configured as being a dedicated device for the control of a developer replenishment operation, or may be configured as a part of a central control device that controls the overall operation of the image forming apparatus 1.

As illustrated in FIG. 2, each of concentration sensors 28(Y, M, C, K) that individually detect the concentration of the respective developers 90(Y, M, C, K) (for example, the concentration of a toner in a case of a two-component developer) existing in the developing devices 24(Y, M, C, K) is connected to the control device 15, and detection information of each sensor is individually input to the control device 15.

Further, the control device 15 is connected with a timer 16 that measures (detects) the time (non-operation time) passed after the last (preceding) replenishment operation of the first transport member 65 of each of the replenishment devices 60(Y, M, C, K) is completed, a temperature sensor 17 that detects the temperature inside the case 10, and a humidity sensor 18 that detects the humidity inside the case 10, so that detection information of each sensor or the timer is input to the control device 15.

Meanwhile, the control device 15 is connected to the first driving device 66 and the second driving device 78 (that is, respective drive controllers thereof) which are control targets, and transmits a control signal necessary for each control target.

Figure 4:
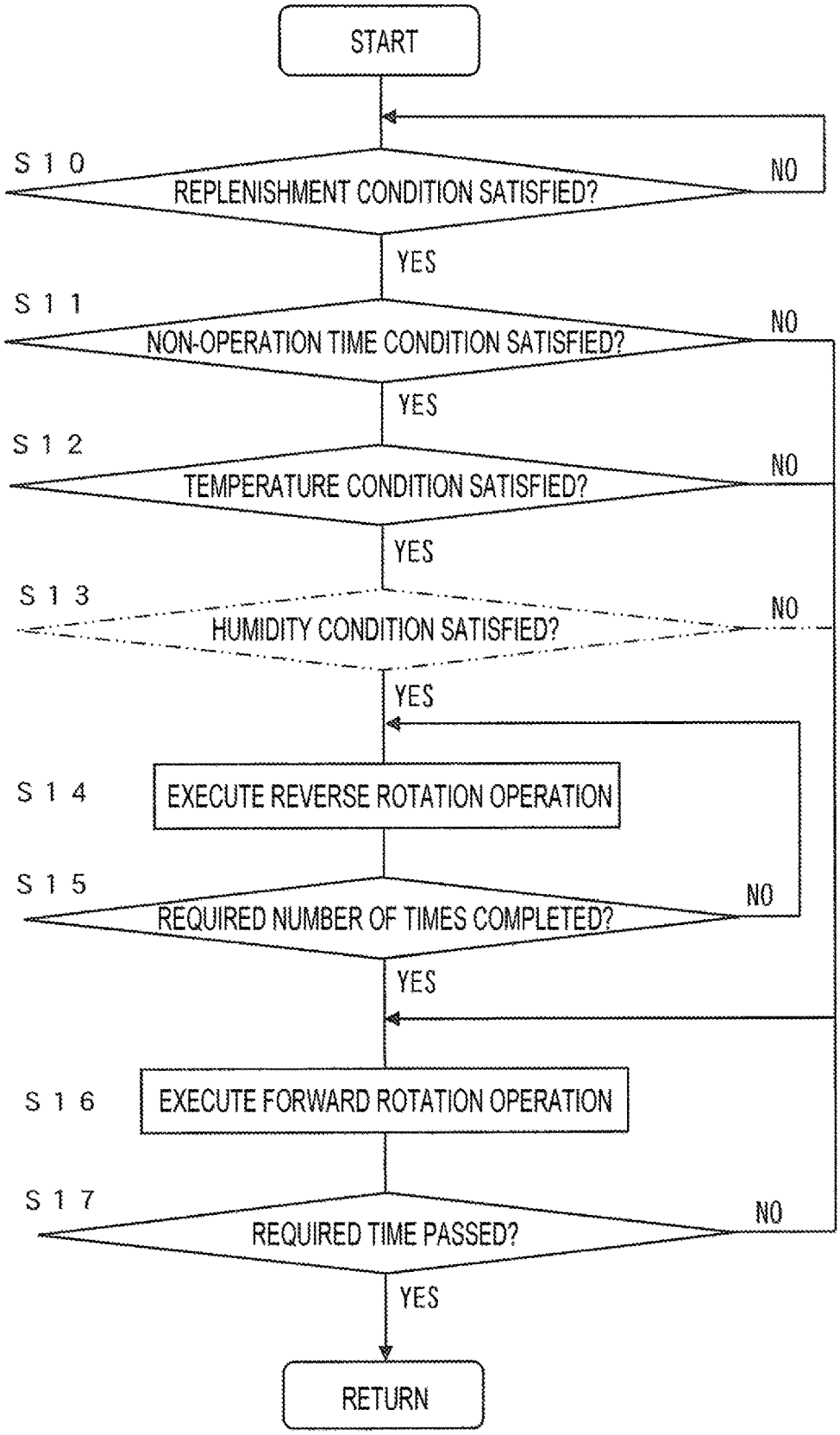

Then, as illustrated in FIG. 4, the replenishment device 60(Y, M, C, K) is configured such that the first driving device 66 rotates the first transport member 65 in reverse when both (i) the non-operation time during which the first transport member 65 is not rotated and (ii) the detection information on the temperature satisfy a condition.

The condition at this time refers to a criterion for determining whether the first transport member 65 needs to be rotated in reverse. At least one condition may be prepared as a condition regarding the non-operation time, and at least one condition may be prepared as a condition regarding the detection information on the temperature. In this case, the condition regarding the non-operation time may be set to, for example, 48 hours or more, and the condition regarding the detection information on the temperature may be set to, for example, 40 degrees (° C.).

Further, the amount of a reverse rotation operation at this time is set to any amount within a range in which no problem occurs due to the reverse rotation of the first transport member 65. The reverse rotation operation may be set, for example, such that reverse rotation by half turn is once.

An operation of rotating the first transport member 65 in reverse is executed by configuring the first driving device 66 to enable driving in which the rotation direction thereof is switched so as to rotate the first transport member 65 forward and in reverse. In the first exemplary embodiment, a motor that is able to switch between forward rotation and reverse rotation is adopted as the motor constituting the first driving device 66.

Further, as the above-mentioned condition, for example, as illustrated in FIG. 6A, plural conditions regarding the non-operation time and plural conditions regarding the detection information on the temperature may be prepared, and conditions of combining these may also be applied. In this case, for example, as illustrated in FIG. 6A, a condition A may be set to 48 hours and a condition B may be set to 96 hours with regard to the non-operation time, and a condition D may be set to 25° C. and a condition E may be set to 35° C. with regard to the detection information on the temperature.

When a combined condition is applied as the above-mentioned condition, plural types of the amount of the reverse rotational operation may also be set. In other words, in this case, the amount of the reverse rotational operation is changed according to how the combined condition is satisfied.

Next, an operation of the replenishment device 60(Y, M, C, K) will be described with reference to FIG. 4 and the like.

First, the control device 15 determines whether detection information of each concentration sensor 28(Y, M, C, K) satisfies the condition as a criterion for determining that replenishment is required (step S10). When there is information determined to satisfy the replenishment condition, the replenishment of the developer by the corresponding replenishment device 60(Y, M, C, K) that satisfies the condition is performed.

Further, before the replenishment device 60(Y, M, C, K) starts a replenishment operation of the developer and further a transport operation by forward rotation of the first transport member 65, it is determined whether detection information of each timer 16(Y, M, C, K) satisfies the condition regarding the non-operation time (S11), and it is determined whether detection information of the temperature sensor 17 satisfies the condition regarding the temperature (S12).

When it is determined in steps S11 and S12 that at least one of the non-operation or the detection information on the temperature does not satisfy the condition, an operation in which the first driving device 66 of the corresponding replenishment device 60(Y, M, C, K) operates to rotate the first transport member 65 forward is executed under the control of the control device 15 (S16). This forward rotation operation is performed until a required operation time that is predetermined so as to correspond to a target replenishment amount has passed (S17).

In this case, in the corresponding replenishment device 60(Y, M, C, K), the spiral first transport member 65 is rotated forward in the transport path 63*a* of the transport pipe 63 of the transport unit 62(Y, M, C, K).

Thus, as illustrated in FIG. 3, the replenishment developer 91 is transported to the discharge port 63*c* along the transport direction M upon receiving a transport force by the transport blade 65*b* of the first transport member 65 in the transport path 63*a* of the transport pipe 63 and thereafter, is discharged from the discharge port 63*c* to drop through the inside of the connection pipe 64 as indicated by the broken line arrow N, and is transported to the developer replenishment portion 245 of the corresponding developing device 24(Y, M, C, K). At this time, the replenishment developer 91 is transported to the developer replenishment portion 245 by the amount substantially corresponding to the amount of the forward rotation operation of the first transport member 65.

As a result, the corresponding developing device 24(Y, M, C, K) is replenished with a required amount of the replenishment developer 91. Further, the replenished developer 91 is transported to the accommodating portion of the main body 240 by the transport member 242B and is mixed and used with the existing developer 90.

Incidentally, the corresponding replenishment device 60(Y, M, C, K) executes an operation in which the second driving device 78 operates to rotate the second transport member 73 forward under the control of the control device 15.

Thus, the replenishment developer 91 in the corresponding developer container 71(Y, M, C, K) is transported to the discharge port 71*a* along a transport direction J1 upon receiving a transport force of the second transport member 73 and thereafter, is discharged from the discharge port 71*a* to drop through the inside of the developer receiving part 77 as indicated by the broken line arrow J2, and is transported into the transport path 63*a* through the connection port 63*b* of the transport pipe 63. As a result, the transport path 63*a* of the transport pipe 63 is replenished with the replenishment developer 91.

Meanwhile, when it is determined in steps S11 and S12 that both the non-operation time and the detection information on the temperature satisfy the respective conditions, an operation in which the first driving device 66 of the corresponding replenishment device 60(Y, M, C, K) operates to rotate the first transport member 65 in reverse is executed under the control of the control device 15 (S14). Further, the reverse rotation operation is performed until a predetermined required number of times is completed (S15).

In this case, in the corresponding replenishment device 60(Y, M, C, K), the spiral first transport member 65 is rotated in reverse by a required number of times in the transport path 63*a* of the transport pipe 63 of the transport unit 62(Y, M, C, K).

Thus, the replenishment developer 91 present in the transport path 63*a* of the transport pipe 63 is moved in a direction different from that at the time of transport by the transport blade 65*b* of the first transport member 65 which is rotated in reverse inside the transport path 63*a*.

As a result, the replenishment developer 91, which has continued to stay in the transport path 63*a* of the transport pipe 63 for a relatively long time and under a high temperature environment, thus showing lower fluidity and higher aggregation degree, reaches a loosened state by the reverse rotation of the first transport member 65.

Accordingly, in the replenishment device 60(Y, M, C, K) and further in the image forming apparatus 1 including the replenishment device 60(Y, M, C, K), the transport path 63*a* of the transport pipe 63 in which the first transport member 65 is disposed is prevented from being blocked or narrowed by aggregation of the replenishment developer 91.

Thus, in the replenishment device 60(Y, M, C, K), there is no possibility that the transport path 63*a* of the transport pipe 63 is clogged with the replenishment developer 91, and the replenishment of the developer 91 is stably performed. Further, in the image forming apparatus 1, good development or image formation is continuously performed.

Meanwhile, in a case where the operation in which the first driving device 66 of the corresponding replenishment device 60(Y, M, C, K) operates to rotate the first transport member 65 in reverse is not executed when it is determined that both the non-operation time and the detection information on the temperature satisfy the respective conditions, the following problems may occur.

That is, when the respective conditions are satisfied, since the first transport member 65 stops and the replenishment developer 91 continues to stay in the transport path 63*a* of the transport pipe 63 for a relatively long time and under a high temperature environment, the replenishment developer 91 shows lower fluidity and higher aggregation degree. Further, the degree of aggregation degree is likely to increase in the transport path 63*a* of the transport pipe 63 since the replenishment developer 91 continues to stay under pressure in gaps of the transport blade 65*b* of the spiral first transport member 65 or between the transport blade 65*b* and the transport path 63*a*.

Thus, in a case where the first transport member is not rotated in reverse when the respective conditions are satisfied, there is a possibility that the developer 91 may aggregate to block or narrow the transport path 63*a* of the transport pipe 63. In the worst case, this phenomenon may cause the transport pipe 63 to be completely clogged with the replenishment developer 91.

Further, as illustrated in FIG. 4, in the replenishment device 60(Y, M, C, K), the operation of rotating the first transport member 65 in reverse is performed before the transport operation of the replenishment developer 91 by forward rotation of the first transport member 65 is started.

Thus, in the replenishment device 60(Y, M, C, K), the loosened replenishment developer 91 is transported when the transport operation is started. At this time, when the first transport member 65 starts to rotate forward after rotating in reverse, the replenishment developer 91 immediately after being loosened is transported. As a result, the transport path 63*a* of the transport pipe 63 is prevented from being blocked or narrowed by the replenishment developer 91, and the corresponding developing device 24(Y, M, C, K) is replenished with the loosened developer 91.

Finally, since the image forming apparatus 1 includes at least the developing device 24 which is an example of an operating unit and the replenishment device 60 which is an example of a powder transport device, from this viewpoint, the image forming apparatus 1 serves as an example of a powder using apparatus that uses powder.

Modification of First Exemplary Embodiment

The replenishment device 60(Y, M, C, K) or the image forming apparatus 1 according to the first exemplary embodiment may include detection information on a humidity as the detection information that is used when determining whether the first transport member 65 needs to be rotated in reverse.

In this case, detection information of the humidity sensor 18 may be used as the detection information on the humidity. Further, at least one condition regarding the humidity may be prepared. When there is one condition regarding the humidity, the condition may be set to, for example, 50% RH or more. Furthermore, determination as to whether the detection information of the humidity sensor 18 satisfies one condition regarding the humidity may be performed in step S13 after the step S11 of determination as to the non-operation time and the step S12 of determination as to the temperature as indicated by the two-dot dash line in FIG. 4.

In a case where the detection information on the humidity is included as described above, since the fluidity or the aggregation degree of the replenishment developer 91 is also affected by the humidity, the transport path 63*a* of the transport pipe 63 is more appropriately prevented from being blocked or narrowed by aggregation of the replenishment developer 91 as compared with a case where the humidify detection information is not included.

Further, the replenishment device 60(Y, M, C, K) or the image forming apparatus 1 according to the first exemplary embodiment may be configured to apply a combined condition as the condition that is used when determining whether the first transport member 65 needs to be rotated in reverse.

In this case, a combined condition of the non-operation time and the temperature as illustrated in FIG. 6A may be applied as the combined condition. Further, in a case of applying this combined condition, plural types of the amount of the reverse rotation operation may be set.

Figure 5:
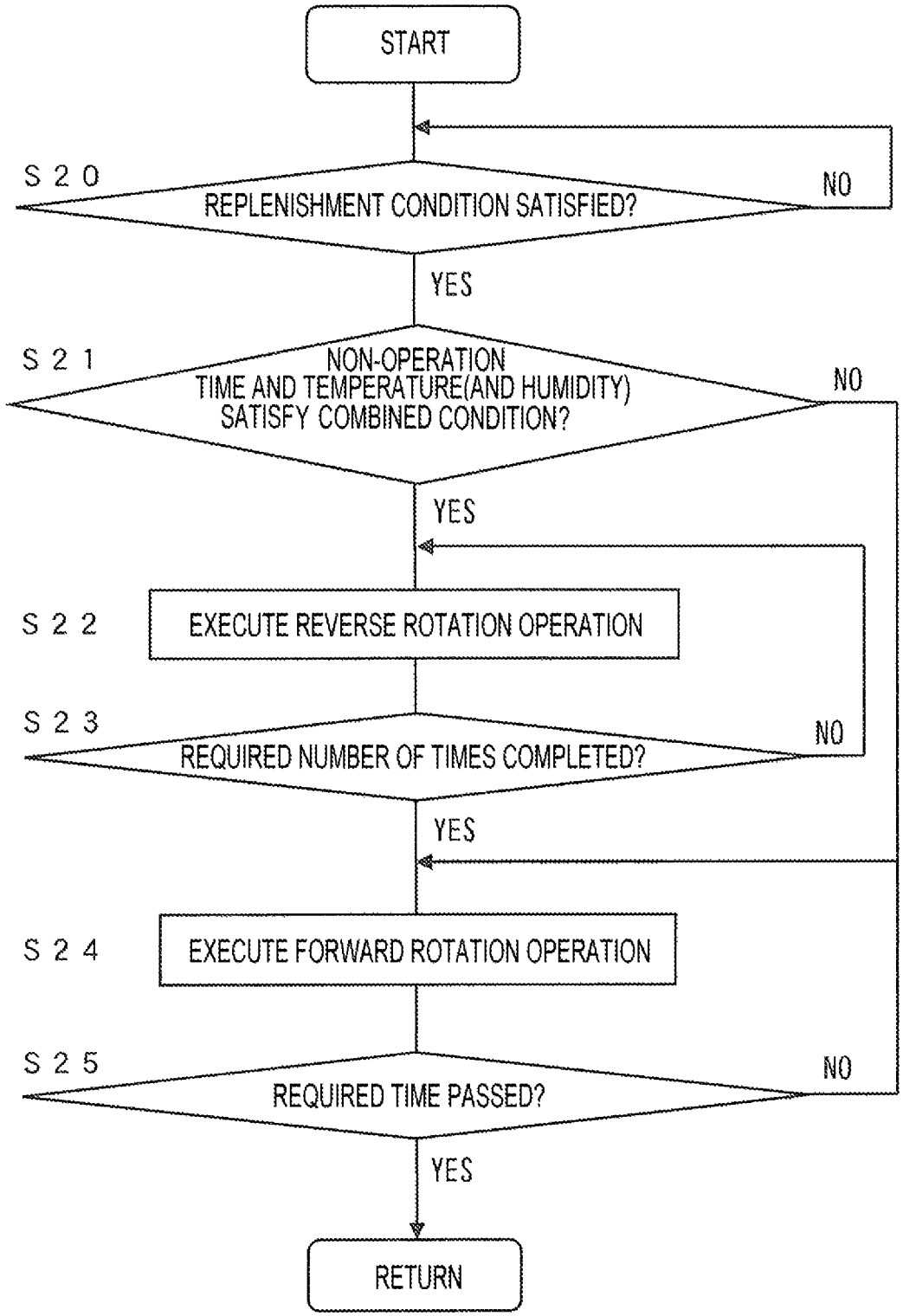
FIG. 5 is a flowchart illustrating a control operation for the replenishment device and the like when a combined condition is applied.

Then, in the case of applying this combined condition, as illustrated in FIG. 5, when it is determined in step S20 that the developer replenishment condition is satisfied, it is determined whether both the non-operation time and the detection information on the temperature satisfy the combined condition (S21). Satisfying the condition at this time means that a combined condition to perform the operation of rotating the first transport member 65 in reverse is satisfied.

When neither of the non-operation time and the detection information on the temperature satisfies the combined condition in step S21, that is, when a combined condition to not perform the operation of rotating the first transport member 65 in reverse is satisfied, an operation in which the first driving device 66 operates to rotate the first transport member 65 forward is executed until a required time has passed under the control of the control device 15 (S24 and S25), and an operation of replenishing the replenishment developer 91 is performed.

Meanwhile, when both the non-operation time and the detection information on the temperature satisfy the combined condition in step S21, an operation in which the first driving device 66 operates to rotate the first transport member 65 in reverse is executed until a required number of times is completed under the control of the control device 15 (S22 and S23). At this time, the reverse rotation operation is performed once, twice, three times, or five times when the combined condition illustrated in FIG. 6A is adopted.

Further, when this combined condition is satisfied, the replenishment operation of the developer 91 is performed in succession after the reverse rotation operation is completed (S24 and S25).

In a case of applying the combined condition as described above, the transport path 63*a* of the transport pipe 63 in which the first transport member 65 is disposed is more reliably prevented from being blocked or narrowed by the replenishment developer 91 as compared with a case where the number of times by which the reverse rotation operation of the first transport member 65 is performed does not change. Further, in this case, since the combined condition of the non-operation time and the temperature is applied, the transport path 63*a* of the transport pipe 63 is more appropriately prevented from being blocked or narrowed by the replenishment developer 91 according to the situation (the situation of the image forming apparatus 1 or the situation of each replenishment device 60).

Further, in the case of applying this combined condition, a combined condition including a condition regarding the humidity may be applied as illustrated in FIG. 6B.

With such a configuration, since a combined condition of the non-operation time, the temperature, and the humidity is applied, the transport path 63*a* of the transport pipe 63 is more appropriately prevented from being blocked or narrowed by the replenishment developer 91 according to the situation (the situation of the image forming apparatus 1 or the situation of each replenishment device 60).

Further, the replenishment device 60(Y, M, C, K) or the image forming apparatus 1 according to the first exemplary embodiment may be configured to perform an operation of rotating the first transport member 65 in reverse before a developing operation of the developing device 24(Y, M, C, K) which operates so as to use the developer 90 and further an image forming operation accompanied by the developing operation are started.

In this case, information regarding a request (command) signal for the image forming operation is input to the control device 15. Further, in this case, when the control device 15 receives the request signal for the image forming operation, the first driving device 66 of the transport unit 62(Y, M, C, K) of the corresponding replenishment device 60(Y, M, C, K) operates to rotate the spiral first transport member 65 in reverse by a required number of times in the transport path 63*a* of the transport pipe 63 under the control of the control device 15.

With such a configuration in which the operation of rotating the first transport member 65 in reverse is performed before the developing operation and further the image forming operation are started, the loosened replenishment developer 91 may be transported to the corresponding developing device 24(Y, M, C, K) when the developing operation by the developing device 24(Y, M, C, K) which is an example of an operating unit is started, as compared with a case where the reverse rotation operation is not performed before the developing operation and further the image forming operation accompanied by the developing operation are started.

Furthermore, the replenishment device 60(Y, M, C, K) or the image forming apparatus 1 according to the first exemplary embodiment may be configured to rotate the second transport member 73 in reverse in the developer container 71(Y, M, C, K) in conjunction with the operation of rotating the first transport member 65 in reverse.

In this case, the second driving device 78 of the corresponding replenishment device 60(Y, M, C, K) may operate to rotate the second transport member 73 in reverse by a predetermined amount (number of times) under the control of the control device 15.

Further, with such a configuration, the replenishment developer 91 accommodated in the developer container 71(Y, M, C, K) is moved and loosened by the reverse rotation of the second transport member 73, as compared with a case where the second transport member 73 is not rotated in reverse in conjunction with the operation of rotating the first transport member 65 in reverse. Thus, the developer receiving part 77 of the transport unit 62 of the corresponding replenishment device 60(Y, M, C, K) is replenished with the loosened replenishment developer 91 transported from the developer container 71(Y, M, C, K).

Second Exemplary Embodiment

Figure 7:
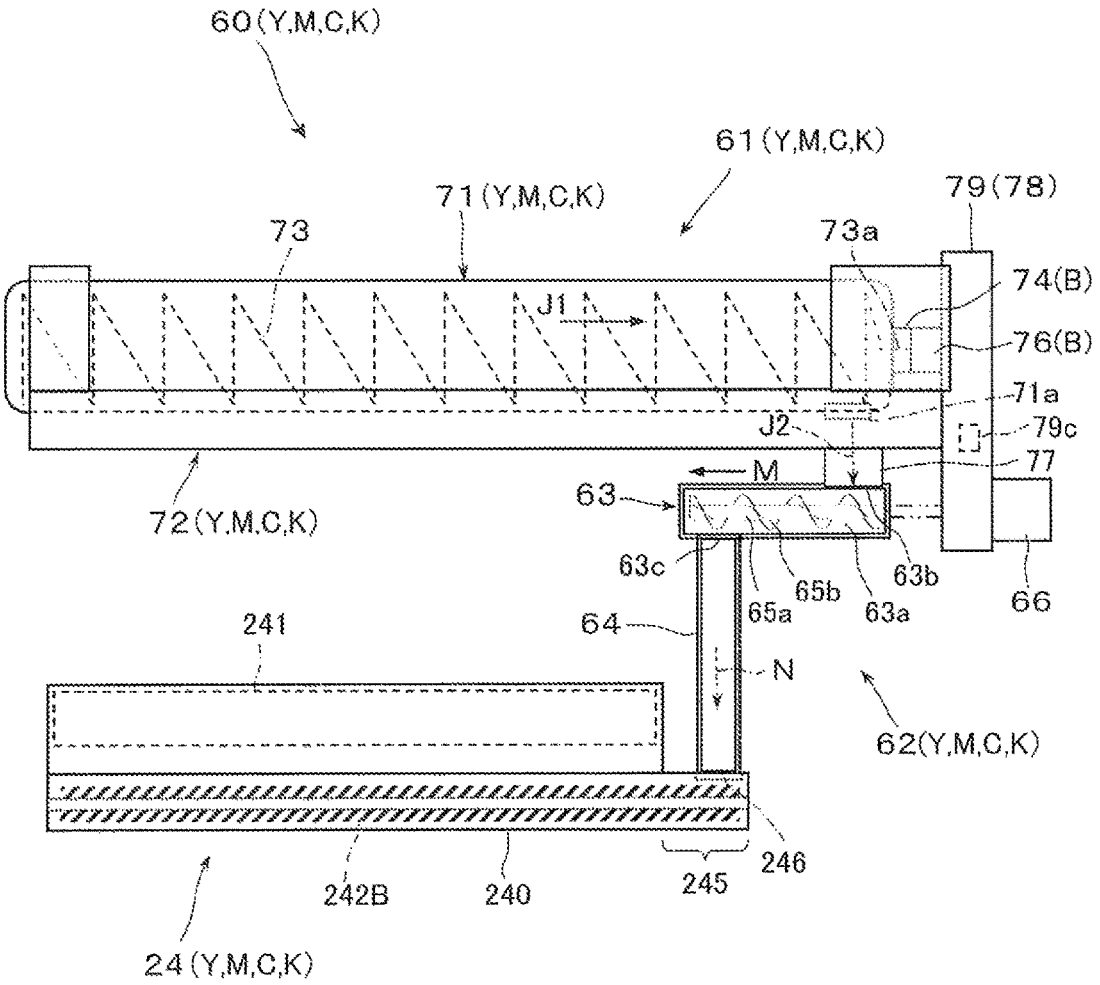
FIG. 7 is a schematic view illustrating the replenishment device according to a second exemplary embodiment as viewed from the lateral side.

FIG. 7 illustrates the replenishment device 60(Y, M, C, K) according to a second exemplary embodiment of the present disclosure.

The replenishment device 60(Y, M, C, K) has the same configuration as the replenishment device 60(Y, M, C, K) (FIG. 2 or FIG. 3) of the first exemplary embodiment except that the first driving device 66 that drives the first transport member 65 also functions as the second driving device 78 that drives the second transport member 73.

The first driving device 66 according to the second exemplary embodiment is configured to transmit a rotational force thereof to the second transport member 73 via a power transmission mechanism 79.

The power transmission mechanism 79 at this time is capable of switching between a transmission state where the first driving device 66 transmits a rotational force for forward rotation of the first transport member 65 to the second transport member 73 and a non-transmission state where the first driving device 66 does not transmit a rotational force for reverse rotation of the first transport member 65 to the second transport member 73. The power transmission mechanism 79 capable of switching between the transmission state and the non-transmission state is, for example, a device having a functional unit (for example, a switching gear) 79*c* capable of shifting and switching some transmission gears between a transmission position for engagement with a gear train and a non-transmission position for separation from the gear train. The shifting of the transmission gears by the functional unit 79*c* is performed by a moving unit (not illustrated).

In the replenishment device 60(Y, M, C, K), in a case where it is determined that it is necessary to replenish the replenishment developer 91 and when it is determined that any one piece of detection information does not satisfy a condition and that the first transport member 65 does not need to be rotated in reverse, the corresponding first driving device 66 operates to rotate the first transport member 65 forward under the control of the control device 15. Thus, in the corresponding replenishment device 60(Y, M, C, K), the replenishment developer 91 in the transport path 63*a* of the transport pipe 63 is transported by the first transport member 65, and the corresponding developing device 24(Y, M, C, K) is replenished with the replenishment developer 91.

Further, at this time, the rotational force with which the corresponding first driving device 66 operates to rotate the first transport member 65 forward is transmitted as power of rotating the second transport member 73 forward in the corresponding developer container 71(Y, M, C, K) via the power transmission mechanism 79. Thus, in the corresponding replenishment device 60(Y, M, C, K), the replenishment developer 91 in the corresponding developer container 71(Y, M, C, K) is transported by the second transport member 73 and is supplied to the developer receiving part 77 of the replenishment device 60(Y, M, C, K).

Meanwhile, when in a case where the replenishment is necessary, when it is determined that all pieces of detection information satisfy a condition and that the first transport member 65 needs to be rotated in reverse, the corresponding first driving device 66 operates to rotate the first transport member 65 in reverse under the control of the control device 15. Thus, in the corresponding replenishment device 60(Y, M, C, K), the replenishment developer 91 is loosened in the transport path 63*a* of the transport pipe 63.

Further, at this time, the rotational force with which the corresponding first driving device 66 operates to rotate the first transport member 65 in reverse is not transmitted to the second transport member 73 in the corresponding developer container 71(Y, M, C, K) as the functional unit 79*c* of the power transmission mechanism 79 operates to shift some transmission gears to the non-transmission position.

After the operation of rotating the first transport member 65 in reverse is completed, the above-described replenishment operation of the developer 91 is equally executed.

Accordingly, in the replenishment device 60(Y, M, C, K), the replenishment developer 91 accommodated in the developer container 71(Y, M, C, K) is moved and loosened by the reverse rotation of the second transport member 73, as compared with a case where the second transport member 73 is not rotated in reverse in conjunction with the operation of rotating the first transport member 65 in reverse. Thus, the developer receiving part 77 of the transport unit 62 of the corresponding replenishment device 60(Y, M, C, K) is replenished with the loosened replenishment developer 91 transported from the developer container 71(Y, M, C, K).

Further, the replenishment device 60(Y, M, C, K) is simplified by omission of the second driving device 78, as compared with a case where the first driving device 66 does not also function as the second driving device 78.

Modification of Second Exemplary Embodiment

Figure 8A:
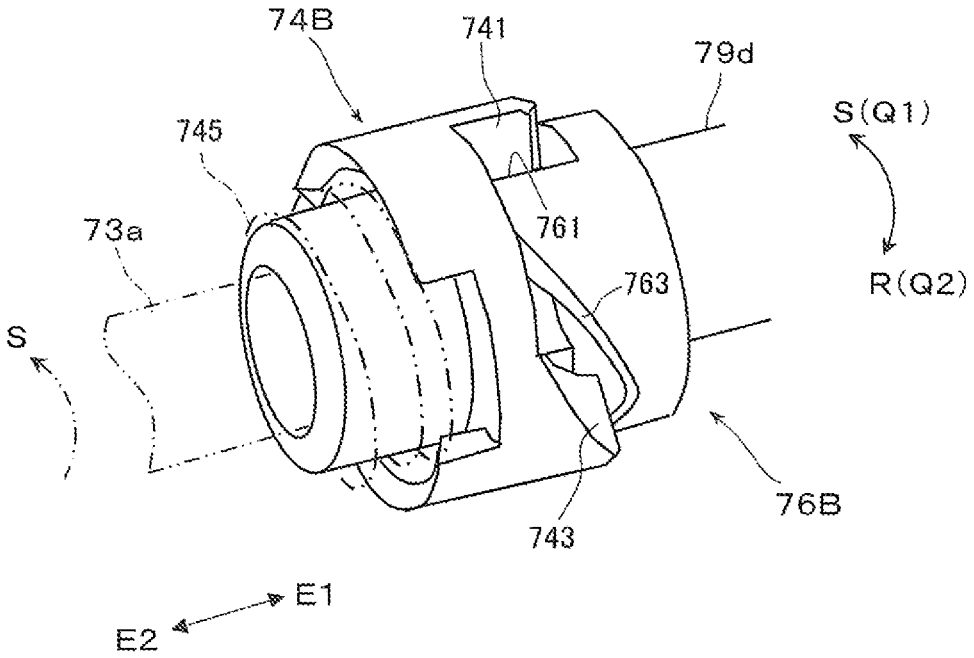
FIG. 8A is a schematic perspective view illustrating a one-way transmission joint of the replenishment device of FIG. 7.
Figure 8B:
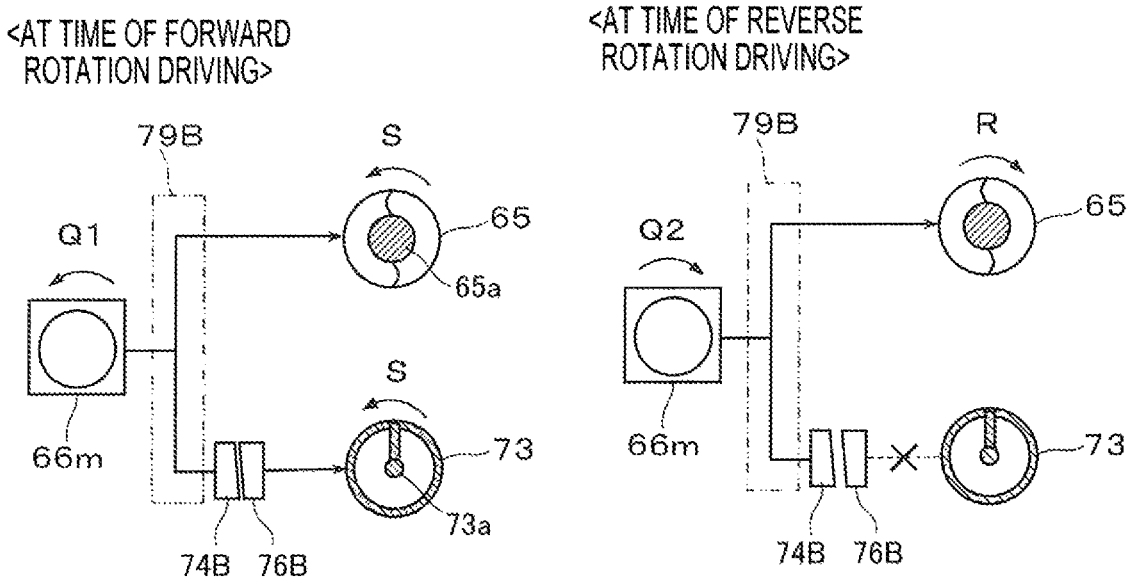
FIG. 8B is a conceptual diagram illustrating an operation state of each transport member by the one-way transmission joint.

As illustrated in FIGS. 8A and 8B, the replenishment device 60(Y, M, C, K) or the image forming apparatus 1 according to the second exemplary embodiment may be configured such that the rotational force output from the first driving device 66 is transmitted via a normal power transmission mechanism 79B (having no functional unit 79*c*) which is connected to the second transport member 73 via one-way transmission joints 74B, 76B that transmit only power for forward rotation, instead of the power transmission mechanism 79 having the functional unit 79*c* that shifts the transmission gears.

For example, as illustrated in FIG. 8A, the one-way transmission joints 74B and 76B are, respectively, a driven-side one-way transmission joint 74B having a contact transmission surface 741 and a separation guide surface 743 and a driving-side one-way transmission joint 76B having a contact transmission surface 761 that may come into contact with the contact transmission surface 741 and a separation guide surface 763 having a slope shape that is guided in a direction of being separated by coming into contact with the separation guide surface 743. Further, the one-way transmission joint 74B is slidable within a required range relative to the rotating shaft portion 73*a* of the second transport member 73, and is elastically pressed by a pressure member 745 such as a spring against a direction E1 of approaching the other one-way transmission joint 76B.

In the replenishment device 60(Y, M, C, K) to which the one-way transmission joints 74B and 76B are applied, as illustrated in the left half of FIG. 8B, at the time of forward rotation driving, a motor 66*m* of the first driving device 66 rotates in a rotation direction Q1 for forward rotation, and the rotational force in the rotation direction Q1 is transmitted as the rotational force in a direction S of rotating the first transport member 65 forward via the normal power transmission mechanism 79B. Further, at this time, the rotational force in the rotation direction Q1 of the motor 66*m* is also transmitted to the second transport member 73 as the rotational force in the direction S of rotating the second transport member 73 forward via the normal power transmission mechanism 79B and the one-way transmission joints 74B and 76B.

At this time, in the one-way transmission joints 74B and 76B, as illustrated in FIG. 8A, since the rotational force in the rotation direction Q1 of the motor 66*m* is transmitted as the rotational force in the forward rotation direction S from a transmission output shaft 79*d* of the normal power transmission mechanism 79B to the one-way transmission joint 76B to rotate the one-way transmission joint 76B in the corresponding direction S, the contact transmission surface 761 of the one-way transmission joint 76B is brought into contact with the contact transmission surface 741 of the one-way transmission joint 74B.

As a result, the contact transmission surface 761 is kept in contact with the contact transmission surface 741. Thus, the rotational force in the forward rotation direction S transmitted to the one-way transmission joint 76B is transmitted to the second transport member 73 via the one-way transmission joint 74B.

Meanwhile, in the replenishment device 60(Y, M, C, K), as illustrated in the right half of FIG. 8B, at the time of reverse rotation driving, the motor 66*m* of the first driving device 66 is rotated in a rotation direction Q2 for reverse rotation, and the rotational force in the rotation direction Q2 is transmitted as the rotational force in a direction R of rotating the first transport member 65 in reverse via the normal power transmission mechanism 79B.

However, at this time, the transmission of the rotational force in the rotation direction Q2 of the motor 66*m* is cut off at the one-way transmission joints 74B and 76B and is not transmitted as the rotational force in the direction of rotating the second transport member 73 in reverse.

That is, in the one-way transmission joints 74B and 76B at this time, as illustrated in FIG. 8B, since the rotational force in the rotation direction Q2 of the motor 66*m* is transmitted as the rotational force in the reverse rotation direction R from the transmission output shaft 79*d* of the normal power transmission mechanism 79B to the one-way transmission joint 76B to rotate the one-way transmission joint 76B in the corresponding direction R, the separation guide surface 763 of the one-way transmission joint 76B is brought into contact with the separation guide surface 743 of the one-way transmission joint 74B.

As a result, the separation guide surface 763 moves in contact with the separation guide surface 743, so that the one-way transmission joint 74B is shifted in a separation direction indicated by the arrow E2 against the pressure force of the pressure member 745. Thus, the rotational force in the reverse rotation direction R transmitted to the one-way transmission joint 76B is interrupted so as not to be transmitted to the one-way transmission joint 74B and thus, is also not transmitted to the second transport member 73.

Third Exemplary Embodiment

Figure 9:
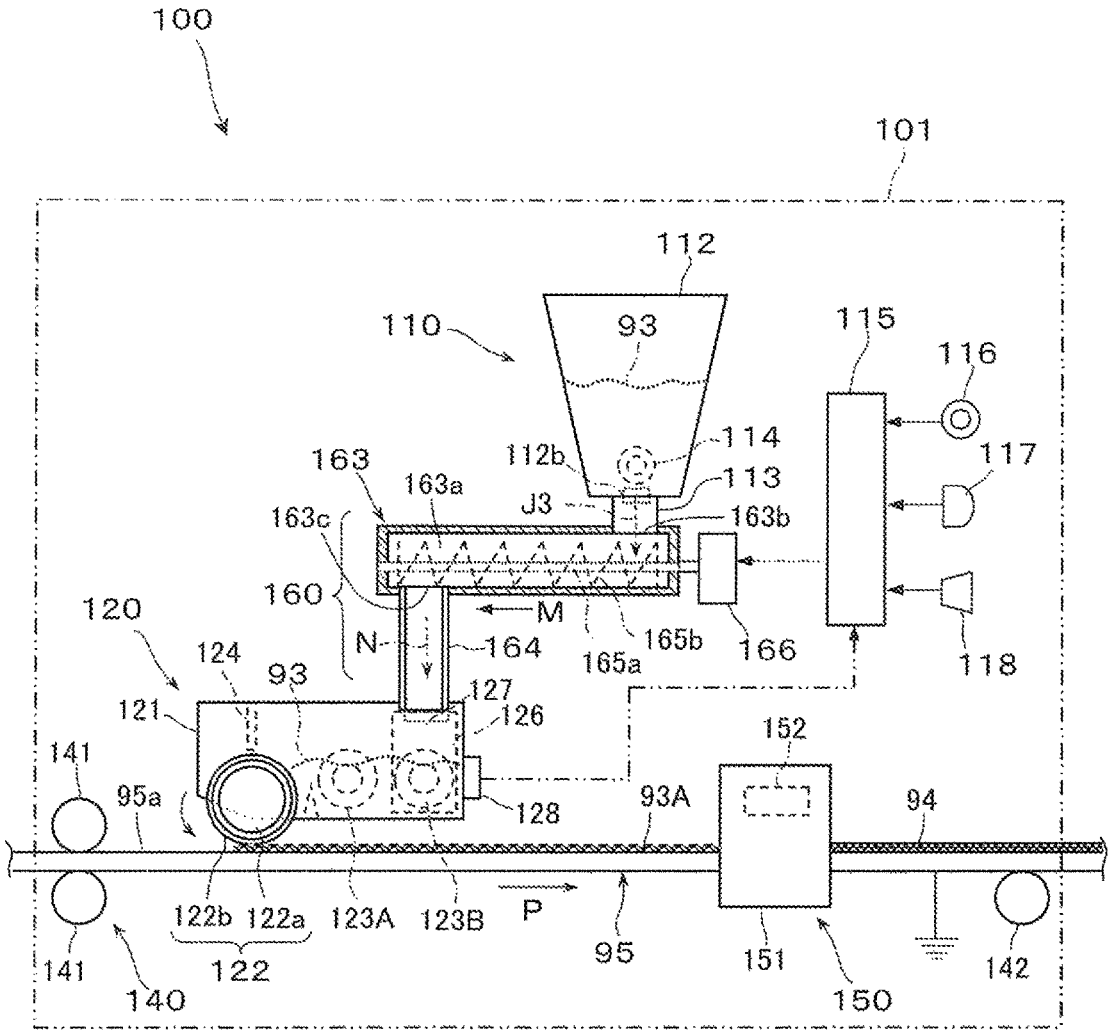
FIG. 9 is a schematic view illustrating a powder coating apparatus according to a third exemplary embodiment.

FIG. 9 illustrates a powder coating apparatus 100 according to a third exemplary embodiment of the present disclosure.

The powder coating apparatus 100 includes, for example, an accommodating unit 110 which accommodates a powder coating material 93 which is an example of powder, a coating unit 120 which is an example of an operating unit that coats a target coating object 95 with the powder coating material 93 accommodated in the accommodating unit 110, a heating unit 150 which heats the powder coating material 93 applied to a target coating surface 95*a* of the target coating object 95, a transport device 140 which transports the target coating object 95 to pass through the coating unit 120 and the heating unit 150, and a transport unit 160 which transports the powder coating material 93 in the accommodating unit 110 so as to be replenished to the coating unit 120.

Further, the powder coating apparatus 100 is disposed inside a case 101 (not illustrated) provided with a carry-in port and a carry-out port for the target coating object 95.

The accommodating unit 110 includes a container 112 that accommodates therein the powder coating material 93 and is provided in the bottom surface thereof with a discharge port 112*b* through which the powder coating material 93 is discharged, a connection pipe 113 that interconnects the discharge port 112*b* of the container 112 and the transport unit 160, and a delivery member 114 that delivers the powder coating material 93 in the container 112 from the discharge port 112*b* by rotation thereof. The container 112 may be fixedly provided, or may be detachably replaceable.

The powder coating material 93 is powder having powder particles each including, for example, a core portion containing a thermosetting resin and a thermal curing agent and a resin coating portion over the surface of the core portion. Further, for example, a transparent powder coating material (clear coating material) containing no coloring agent in powder particles or a colored powder coating material containing a coloring agent in powder particles is used as the powder coating material 93. In addition to this, powder formed of a thermoplastic resin may be used as the powder coating material 93.

The target coating object 95 is a conductive sheet-shaped medium having a sheet shape or a plate shape which includes the target coating surface 95*a* to which the powder coating material 93 may be electrostatically adhered. The target coating object 95 is, for example, a metallic medium such as an aluminum foil, an iron plate or a copper plate, a conductive synthetic resin, or a nonmetallic medium formed of a conductive nonmetal material such as conductive rubber. The target coating surface 95*a* may be subjected in advance to a surface treatment such as a primer treatment, a plating treatment, or an electro-deposition coating. The target coating object 95 is grounded (earthed), for example, at the time of powder coating. Incidentally, the grounding of the target coating object 95 may be occasionally omitted since powder coating is possible when there is a potential difference between the target coating object 95 and a coating roller 122 to be described later.

The coating unit 120 is an example of an operating unit that operates so as to use the powder coating material 93 which is an example of powder as described above. The coating unit 120 is configured as a coating device formed by arranging, within a main body (case) 121 provided with an accommodating portion for the powder coating material 93 and an coating opening, components such as the coating roller 122 which applies the powder coating material 93 onto the target coating object 95 by holding the powder coating material 93 in the accommodating portion and transporting the powder coating material 93 so as to approach and pass through the target coating object 95 from the coating opening, transport members 123A and 123B which transport the powder coating material 93 in the accommodating portion while agitating the powder coating material 93 with a magnetic carrier for charging (not illustrated), and an adjustment member 124 which adjusts the amount (layer thickness) of the powder coating material 93 and the like held by the coating roller 122. The powder coating material 93 is not limited to a two-component material in which a magnetic carrier is used in combination with a non-magnetic powder coating material, and may also be a one-component material containing only a powder coating material.

The main body 121 has a long shape in a direction substantially along the width direction at the time of the transport of the coating target object 95. A coating material replenishment portion 126 is provided on one longitudinal end of the main body 121 to protrude from the end. Further, the transport member 123B extends to and is disposed in the coating material replenishment portion 126, and the coating material replenishment portion 126 is provided with a receiving port 127 to receive the replenished powder coating material 93.

The coating roller 122 is, for example, a roller body having a magnet roller 122*a* in which predetermined magnetic poles are present at a predetermined interval in the circumferential direction and a conductive sleeve 122*b* disposed concentrically around the magnet roller 122*a* to perform rotation. A bias voltage is supplied from a power supply (not illustrated) when the powder coating material 93 is applied to the conductive sleeve 122*b*.

The transport device 140 includes, for example, a pair of transport rollers 141, a transport roller 142, and a roller driving device (not illustrated).

The heating unit 150 is configured by arranging, within a main body (case) 151 provided with a carry-in port and a carry-out port for the target coating object 95, a component such as a heat source 152 which heats and hardens, in a non-contact manner, a coating layer 93A of the powder coating material 93 applied to the target coating surface 95*a* of the target coating object 95 in the coating unit 120. The heat source 152, for example, a heat source such as a halogen lamp or a ceramic heater or a laser irradiation device that irradiates an infrared laser. In addition, the heating unit 150 may be configured to heat the coating layer 93A of the powder coating material 93 applied to the target coating surface 95*a* of the target coating object 95 in a contact state using a heating rotating body such as a heating roller or a heating belt.

The transport unit 160 also serves as an example of a powder transport device that transports the powder coating material 93 which is an example of powder.

The transport unit 160 according to the third exemplary embodiment includes a transport pipe 163 disposed such that one end thereof is connected to the discharge port 112*b* of the container 112 of the accommodating unit 110, a connection pipe 164 which interconnects the other end of the transport pipe 163 and the receiving port 127 of the coating material replenishment portion 126 of the coating unit 120, a first transport member 165 which transports the powder coating material 93 by rotating forward in a transport portion of the transport pipe 163, and a first driving device 166 which is an example of a first driving unit that drives the first transport member 165 to rotate.

The transport pipe 163 is an example of a transport unit having a transport path as in the case of the transport pipe 63 according to the first exemplary embodiment and the like. The transport pipe 163 is, for example, a cylindrical pipe, and the inside thereof defines a tubular transport path 163*a*. Further, the transport pipe 163 is provided in one end thereof with a connection port 163*b* which is connected to the connection pipe 113 of the accommodating unit 110 and provided in the other end thereof with a discharge port 163*c* from which the powder coating material 93 is discharged to drop to the connection pipe 164.

The connection pipe 164 is constituted as a cylindrical hollow pipe in which no transport member is disposed, and for example, is configured to drop and transport the powder coating material 93 toward the receiving port 127 of the coating material replenishment portion 126 of the coating unit 120.

As illustrated in FIG. 9, the first transport member 165 is a member that includes a rotating shaft 165*a* extending along the transport path 163*a* of the transport pipe 163 and a transport blade 165*b* continuously formed on the outer circumferential surface of the rotating shaft 165*a* so as to be spirally wound thereon.

The first transport member 165 transports the powder coating material 93 in a transport direction M so as to move the powder coating material 93 toward the discharge port

163*c* of the transport pipe 163. A transport operation by forward rotation of the first transport member 165 is executed so as to correspond to a required replenishment amount of the powder coating material 93. The first transport member 165 is disposed such that the transport blade 165*b* thereof rotates in a state of being close to the transport path 163*a* of the transport pipe 163.

The first driving device 166 includes a motor, a gear train mechanism, and the like.

Further, in the powder coating apparatus 100, as illustrated in FIG. 9, an operation of the transport unit 160 is controlled by a control device 115.

The control device 115 has substantially the same configuration as the control device 15 according to the first exemplary embodiment and the like. Similarly, the control device 115 is connected with a remaining amount sensor 128 that detects the remaining amount of the powder coating material 93 existing in the main body 121 of the coating unit 120, a timer 116 that measures (detects) the time (non-operation time) passed after the last (preceding) replenishment operation of the first transport member 165 is completed, a temperature sensor 117 that detects the temperature inside the case 101, and a humidity sensor 118 that detects the humidity inside the case 101, so that detection information of each sensor or the timer is input to the control device 115.

Meanwhile, the control device 115 is connected to the first driving device 166 (that is, a drive controller thereof) which is a control target, and transmits a control signal necessary for the control target.

Then, the transport unit 160 of the powder coating apparatus 100 is configured in substantially the same manner as the replenishment device 60 according to the first exemplary embodiment such that the first driving device 166 rotates the first transport member 165 in reverse when both (i) a non-operation time during which the first transport member 165 is not rotated and (ii) detection information on a temperature satisfy a condition.

As for the condition at this time, substantially the same condition as the above-described condition applied to the replenishment device 60 according to the first exemplary embodiment may be applied.

First, coating by the powder coating apparatus 100 is performed as follows.

In the powder coating apparatus 100, the target coating object 95 is transported toward the coating unit 120 in a transport direction indicated by the arrow P by the transport device 140, and in the coating unit 120, the powder coating material 93 which has been agitated with the magnetic carrier to be frictionally charged is applied to the target coating surface 95*a* of the target coating object 95.

At this time, in the coating unit 120, the powder coating material 93 in the main body 121 is held in a grain shape via the magnetic carrier on the coating roller 122 (actually on the conductive sleeve 122*b*) rotating in the direction indicated by the arrow, and is transported so as to pass through a position facing the coating target surface 95*a*. At this time, the powder coating material 93*a* adhering to the magnetic carrier on the coating roller 122 is electrostatically transferred and applied to the coating target surface 95*a* by a potential difference generated between the coating roller 122 to which a bias voltage is supplied and the grounded coating target surface 95*a*. Thus, the coating layer 93A having a substantially constant thickness is formed on the target coating surface 95*a*.

Subsequently, the target coating object 95 having the coating layer 93A formed thereon is transported so as to pass through the heating unit 150 by the transport device 140.

At this time, in the heating unit 150, the coating layer 93A on the target coating surface 95*a* of the target coating object 95 is heated and thermally cured. Thus, the coating layer 93A is formed into a uniform coating film 94 on the target coating surface 95*a*.

In this way, the target coating surface 95*a* of the target coating object 95 is coated with the powder coating material 93.

Next, in the powder coating apparatus 100, since the powder coating material 93 is consumed and is reduced in amount in the coating unit 120 via implementation of the coating operation described above, the powder coating material 93 in the accommodating unit 110 is transported and replenished (supplied) to the coating unit 120 by the transport unit 160.

The replenishment of the powder coating material 93 at this time is performed when detection information of the remaining amount sensor 128 in the coating unit 120 satisfies a condition of requiring replenishment, so that the first driving device 166 of the transport unit 160 operates to rotate the first transport member 165 forward until a required time has passed under the control of the control device 115. At this time, the powder coating material 93 in the transport path 163*a* of the transport pipe 163 is transported in the transport direction M by the first transport member 165 and thereafter, drops to the connection pipe 164 and is transported into the coating material replenishment portion 126 of the coating unit 120.

Further, at this time, the delivery member 114 of the accommodating unit 110 is also rotated for a predetermined time by a driving device (not illustrated). Thus, the powder coating material 93 in the container 112 is delivered and replenished to the transport pipe 163.

Next, in the transport unit 160 of the powder coating apparatus 100, before the replenishment operation of the powder coating material 93 and further the transport operation by forward rotation of the first transport member 165 are started, it is determined whether detection information of the timer 116 satisfies a condition regarding the non-operation time, and it is determined whether detection information of the temperature sensor 117 satisfies a condition regarding the temperature.

In this case, when it is determined that both the non-operation time and the detection information on the temperature satisfy the respective conditions, an operation in which the first driving device 166 operates to rotate the first transport member 165 in reverse is executed until a predetermined required number of times is completed under the control of the control device 115.

Thus, the powder coating material 93 present in the transport path 163*a* of the transport pipe 163 of the transport unit 160 is moved, for example, in a direction different from that at the time of transport by the transport blade 165*b* of the first transport member 165 which rotates in reverse inside the transport path 163*a*.

As a result, the powder coating material 93, which has continued to stay in the transport path 163*a* of the transport pipe 163 for a relatively long time and under a high temperature environment, thus showing lower fluidity and higher aggregation degree, reaches a loosened state by the reverse rotation of the first transport member 165.

Accordingly, in the transport unit 160 and further in the powder coating apparatus 100 including the transport unit 160, the transport path 163*a* of the transport pipe 163 in which the first transport member 165 is disposed is prevented from being blocked or narrowed by aggregation of the powder coating material 93.

Thus, in the transport unit 160, there is no possibility that the transport path 163*a* of the transport pipe 163 is clogged with the powder coating material 93, and the replenishment of the powder coating material 93 is stably performed. Further, in the powder coating apparatus 100, good coating is continuously performed.

Meanwhile, in a case where the operation of rotating the first transport member 165 in reverse is not executed in the transport unit 160 when it is determined that both the non-operation time and the detection information on the temperature satisfy the respective conditions, the following problems may occur in substantially the same manner as the above-described case of the replenishment device 60 according to the first exemplary embodiment.

That is, when the respective conditions are satisfied, since the first transport member 165 stops and the powder coating material 93 continues to stay in the transport path 163*a* of the transport pipe 163 for a relatively long time and under a high temperature environment, the powder coating material 93 shows lower fluidity and higher aggregation degree. Further, the degree of aggregation degree is likely to increase in the transport path 163*a* of the transport pipe 163 since the powder coating material 93 continues to stay under pressure in gaps of the transport blade 165*b* of the spiral first transport member 165 or between the transport blade 165*b* and the transport path 163*a*.

Thus, in a case where the first transport member 165 is not rotated in reverse when the respective conditions are satisfied, there is a possibility that the powder coating material 93 may aggregate to block or narrow the transport path 163*a* of the transport pipe 163. In the worst case, this phenomenon may cause the transport pipe 163 to be completely clogged with the powder coating material 93.

Further, in the transport unit 160, the operation of rotating the first transport member 165 in reverse is performed before the transport operation of the powder coating material 93 by forward rotation of the first transport member 165 is started.

Thus, in the transport unit 160, the loosened powder coating material 93 is transported when the transport operation is started. At this time, when the first transport member 165 starts to rotate forward after rotating in reverse, the powder coating material 93 immediately after being loosened is transported. As a result, the transport path 163*a* of the transport pipe 163 is prevented from being blocked or narrowed by the powder coating material 93, and the loosened powder coating material 93 is transported and replenished to the coating unit 120.

Incidentally, since the powder coating apparatus 100 includes at least the coating unit 120 which is an example of an operating unit and the transport unit 160 which is an example of a powder transport device, from this viewpoint, the powder coating apparatus 100 serves as an example of a powder using apparatus that uses powder.

The modification of the first exemplary embodiment described above may be equally applied to the transport unit 160 or the powder coating apparatus 100.

Further, the transport unit 160 or the powder coating apparatus 100 may be configured in the same manner as the case of the replenishment device 60 described in the second exemplary embodiment or the modification thereof when the accommodating unit 110 is configured using a coating material container that is detachably mounted and has a second transport member which transports the powder coating material 93 toward the discharge port 112*b*.

[Modifications]

The present disclosure is not limited to the description of the first to third exemplary embodiments and also includes, for example, modifications as follows.

In the replenishment device 60(Y, M, C, K) or the image forming apparatus 1 according to the first exemplary embodiment, the developer container 71(Y, M, C, K) of the accommodating unit 61 may be adopted as having information on the date of manufacture, and when the control device 15 determines that detection information on the number of days passed from the date of manufacture of the developer container 71(Y, M, C, K) satisfies a condition, an operation of rotating the second transport member 73 in reverse after the developer container 71(Y, M, C, K) is first mounted on each mounting device 72(Y, M, C, K) may be performed under the control of the control device 15.

With this configuration, aggregation of the replenishment developer 91 that is occurring in a new developer container 71(Y, M, C, K) before mounting is eliminated.

In this case, the developer container 71(Y, M, C, K) may be provided with a storage such as a non-volatile memory in which necessary information such as the date of manufacture is stored. The date of manufacture may be the date corresponding to the time when the replenishment developer 91 is first provided in each container, but the date of manufacture may be regarded as the time when the replenishment developer 91 is accommodated.

Further, in this case, the mounting device 72(Y, M, C, K) of the replenishment device 60(Y, M, C, K) may have a reading device 19 which reads information in the storage of the developer container 71(Y, M, C, K) as illustrated by the two-dot dash line in FIG. 2 and may be configured to connect the reading device 19 to the control device 15 so as to transmit the read detection information.

As for a condition regarding detection information on the number of days that have passed, an appropriate number of days determined from the viewpoint of eliminating a troubled state such as aggregation of the replenishment developer 91 in the developer container 71 is set.

Further, the number of times by which the operation of rotating the second transport member 73 in reverse when this condition is satisfied may be fixed, or may vary according to the number of days that have passed.

Then, the reverse rotation operation in this configuration may be performed, for example, immediately after the corresponding developer container 71(Y, M, C, K) is mounted or immediately before a developer replenishment operation that is first performed after the mounting. This configuration may be equally adopted in the powder coating apparatus 100 according to the third exemplary embodiment when the accommodating unit 110 is configured using a coating material container that is detachably mounted and has a second transport member. When the accommodating unit 110 takes the form of a container that is fixedly disposed without using a coating material container that is detachably mounted, a second transport member that rotates forward to transport the powder coating material 93 may be disposed in the container.

Further, the replenishment device 60(Y, M, C, K) or the image forming apparatus 1 according to the first and second exemplary embodiments may be configured such that at least the conditions regarding the non-operation time and the detection information on the temperature are changed and the number of times by which the operation of rotating the first transport member 65 in reverse is performed is changed according to a difference in the detection information on the frequency of use of the image forming apparatus 1.

In this case, the detection information may include detection information such as a humidity. Further, in this case, as for the frequency of use, for example, when the frequency of use is limited to once a week, the conditions regarding the non-operation time and the detection information on the temperature may be changed to a mild condition to increase the number of times by which the reverse rotation operation is performed. For example, a non-use period from the last power-off to the next power-on may be detected as the frequency of use.

With this configuration, as compared with a case where this configuration is not adopted, the transport path 63*a* of the transport pipe 63 of the transport unit 62 is appropriately prevented from being blocked or narrowed by the replenishment developer 91. This configuration may be equally adopted in the powder coating apparatus 100 according to the third exemplary embodiment by detecting the frequency of use of the powder coating apparatus 100.

Further, the first and second exemplary embodiments have described the configuration examples of the image forming apparatus 1 including plural replenishment devices 60(Y, M, C, K), but the image forming apparatus 1 may include a single replenishment device 60. In other words, the image forming apparatus is not limited to one that forms a multicolor image using developers of plural colors, but may be one that forms a monochromatic image using a developer of one color. In a case of the latter image forming apparatus that forms a monochromatic image, only one replenishment device that replenishes a developer of one color is sufficient for the replenishment device 60.

Further, the third exemplary embodiment has described the configuration example of the powder coating apparatus 100 including the single coating unit 120, but the powder coating apparatus 100 may include plural coating units 120. In this case, the plural coating units 120 are not limited to different types of coating units 120 that use different types of powder coating materials 93, but may be the same type of coating units 120 that use the same type of powder coating material 93.

Further, the present disclosure may also be applied almost equally to a powder transport device that handles powder other than a developer or a powder coating material as long as the powder transport device includes a transport unit having a transport path, a spiral first transport member that is rotatably disposed in the transport path and rotates forward to transport powder, and a driving unit that drives the first transport member to rotate, and the transport path in which the first transport member is disposed is prevented from being blocked or narrowed by the powder.

In this case, examples of the powder other than the developer or the powder coating material may include powder for chemicals, powder for food, or powder for the manufacture of electrodes. Further, the powder transport device may be referred to as a powder supply device when it includes a powder supply source and a powder supply destination.

Further, the present disclosure is not limited to the image forming apparatus or the powder coating apparatus illustrated in the first to third exemplary embodiments as long as a powder using apparatus includes an accommodating unit that accommodates powder, an operating unit that operates so as to use the powder in the accommodating unit, and a transport unit that transports the powder in the accommodating unit to the operating unit and at least a part of the transport unit is configured with the powder transport device, and may also be applied almost equally to other powder using apparatuses.

In this case, examples of the other powder using apparatuses include a manufacturing apparatus using the powder, a machining apparatus using the powder, and an inspection apparatus using the powder.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder using apparatus comprising:

a powder transport device comprising a transport unit having a transport path, a spiral first transport member that is rotatably disposed in the transport path and rotates forward to transport powder, and a first driving unit that drives the first transport member to rotate;

an accommodating unit that accommodates powder and that includes a second transport member that rotates forward to transport the powder, and a second driving unit that drives the second transport member to rotate, wherein the second driving unit rotates the second transport member in reverse in conjunction with the first driving unit rotating the first transport member in reverse; and an operating unit that operates so as to use the powder in the accommodating unit, wherein the transport unit transports the powder in the accommodating unit to the operating unit, and the first driving unit rotates the first transport member in reverse when both (i) and (ii) satisfy a condition, (i) being a non-operation time during which the first transport member is not rotated and (ii) being detection information on a temperature.

2. The powder using apparatus according to claim 1, wherein the first driving unit rotates the first transport member in reverse before the first transport member starts to transport the powder.

3. The powder using apparatus according to claim 2, wherein the first transport member starts to rotate forward after rotating in reverse.

4. The powder using apparatus according to claim 1, wherein a number of times the first driving unit rotates the first transport member in reverse varies.

5. The powder using apparatus according to claim 4, wherein the condition includes a plurality of conditions at different levels, and the number of times the first driving unit rotates the first transport member in reverse varies according to the levels of the conditions.

6. The powder using apparatus to claim 1, wherein the detection information includes detection information on a humidity.

7. The powder using apparatus according to claim 1, wherein the first driving unit rotates the first transport member of the powder transport device in reverse before the operating unit starts to operate so as to use the powder.

8. The powder using apparatus according to claim 7, wherein the condition is changed according to a frequency of use of the powder using apparatus in order to change the number of times the first driving unit rotates the first transport member in reverse.

9. The powder using apparatus according to claim 1, wherein the first driving unit and the second driving unit are one driving unit.

10. The powder using apparatus according to claim 9, wherein the condition is changed according to a frequency of use of the powder using apparatus in order to change the number of times the first driving unit rotates the first transport member in reverse.

11. The powder using apparatus according to claim 1, wherein the accommodating unit includes a powder container that is detachably mounted and has the second transport member and information on a date of manufacture, and when detection information on the number of days that have passed from the date of manufacture of the powder container satisfies a condition, the second driving unit rotates the second transport member in reverse after the powder container is mounted.

12. The powder using apparatus according to claim 1, wherein the accommodating unit includes a plurality of accommodating units, and the transport unit includes a plurality of transport units that are separate from the plurality of accommodating units.

13. The powder using apparatus according to claim 1, wherein the condition is changed according to a frequency of use of the powder using apparatus in order to change the number of times the first driving unit rotates the first transport member in reverse.

* * * * *